US007649512B2

(12) United States Patent
Maruyama

(10) Patent No.: US 7,649,512 B2
(45) Date of Patent: Jan. 19, 2010

(54) ORGANIC EL DISPLAY DEVICE, AND METHOD FOR DRIVING THE ORGANIC EL DISPLAY DEVICE

(75) Inventor: Junichi Maruyama, Niigata (JP)

(73) Assignee: Nippon Seiki Co., Ltd., Niigata (JP)

( * ) Notice: Subject to any disclaimer, the term of this patent is extended or adjusted under 35 U.S.C. 154(b) by 390 days.

(21) Appl. No.: 10/590,772

(22) PCT Filed: Feb. 2, 2005

(86) PCT No.: PCT/JP2005/001483

§ 371 (c)(1),
(2), (4) Date: Aug. 25, 2006

(87) PCT Pub. No.: WO2005/083665

PCT Pub. Date: Sep. 9, 2005

(65) Prior Publication Data

US 2007/0171153 A1 Jul. 26, 2007

(30) Foreign Application Priority Data

Feb. 27, 2004 (JP) ..... 2004-053625

(51) Int. Cl.
*G09G 3/30* (2006.01)

(52) U.S. Cl. ..... 345/76; 345/77; 345/55; 345/204

(58) Field of Classification Search ..... 345/76–77, 345/55, 204
See application file for complete search history.

(56) References Cited

U.S. PATENT DOCUMENTS

| | | | | |
|---|---|---|---|---|
| 2003/0043090 | A1 | 3/2003 | Yazawa et al. | |
| 2003/0122750 | A1 * | 7/2003 | Tamaki | 345/82 |
| 2004/0061670 | A1 * | 4/2004 | Muruyama et al. | 345/76 |
| 2004/0164301 | A1 * | 8/2004 | Suzuki et al. | 257/72 |

FOREIGN PATENT DOCUMENTS

| | | |
|---|---|---|
| JP | 9-230818 | 9/1997 |
| JP | 2000-206935 | 7/2000 |
| JP | 2003-76328 | 3/2003 |
| JP | 2003-150113 | 5/2003 |
| JP | 2003-202835 | 7/2003 |
| JP | 2003-288047 | 10/2003 |

OTHER PUBLICATIONS

Japanese Office Action issued in Japanese Patent Application No. JP 2004-053625, dated Dec. 1, 2005.

* cited by examiner

*Primary Examiner*—Richard Hjerpe
*Assistant Examiner*—Leonid Shapiro
(74) *Attorney, Agent, or Firm*—McDermott Will & Emery LLP

(57) ABSTRACT

Scanning switch means 21 to 2m can connect scanning lines S1 to Sm freely to a first potential or a second potential. Drive switch means 71 to 7n can connect drive lines D1 to Dn freely to a drive current source 70 or an off potential. Control means 8 connects the scanning switch means 21 to 2m sequentially with the first potential to select the scanning lines S1 to Sm sequentially and to control the connected states of the drive switch means 71 to 7n. In accordance with the number of the drive lines D1 to Dn to be connected to the drive current source 70, the control means 8 changes the resistances of the scanning switch means 21 to 2m corresponding to the scanning lines S1 to Sm connected to the second potential to become the unselected state, into at least two stages.

4 Claims, 7 Drawing Sheets

8a

| | |
|---|---|
| 1 | VGS1 |
| 2 | VGS2 |
| 3 | VGS3 |
| ⋮ | ⋮ |
| n | VGSn |

8b

| | t01 | t02 | t03 | ・・・ | t64 |
|---|---|---|---|---|---|
| 1 | VGS101 | VGS102 | VGS103 | ・・・ | VGS164 |
| 2 | VGS201 | VGS202 | VGS203 | ・・・ | VGS264 |
| 3 | VGS301 | VGS302 | VGS303 | ・・・ | VGS364 |
| ⋮ | ⋮ | ⋮ | ⋮ | | ⋮ |
| n | VGSn01 | VGSn03 | VGSn03 | ・・・ | VGSn64 |

FIG. 5

ORGANIC EL DISPLAY DEVICE, AND METHOD FOR DRIVING THE ORGANIC EL DISPLAY DEVICE

RELATED APPLICATION

This application is a national phase of PCT/JP2005/001483 filed on Feb. 2, 2005, which claims priority from Japanese Application No. JP 2004-053625 filed on Feb. 27, 2004, the disclosures of which Applications are incorporated by reference herein. The benefit of the filing and priority dates of the International and Japanese Applications is respectfully requested.

TECHNICAL FIELD

The present invention relates to an organic EL display device having a dot-matrix type organic EL panel, which includes a plurality of anode lines and a plurality of cathode lines, and to a method for driving the organic EL display device.

BACKGROUND ART

In the prior art, there have been proposed a variety of dot-matrix type organic EL panels and their driving methods, as disclosed in Patent Document 1. In this organic EL panel: a plurality of anode lines (as will be called the "drive lines") formed of a conductive transparent film such as ITO are formed on a light-transmitting substrate in a stripe shape; an organic layer is formed on the back of the drive lines; a plurality of cathode lines (as will be called the "scanning lines") of an evaporated metal film of aluminum or the like are formed on the back of the organic layer to intersect the drive lines at the right angle; and the drive lines and the scanning lines clamp the aforementioned organic layer. The organic EL panel thus formed is noted as such a display in place of the liquid crystal display as has a lower power consumption, a higher display quality and a smaller thickness.

Patent Document 1: Japanese Patent No. 3,314,046.

The organic EL display device includes an organic EL panel 1, a cathode drive circuit 2, an anode drive circuit 3, a control unit 4, and a reset circuit 5 (as referred to FIG. 6).

In the organic EL panel 1, pixels E11 to Emn are arranged in a matrix state. These pixels E11 to Emn are disposed at intersections between a plurality of scanning lines S1 to Sm in the longitudinal direction and a plurality of drive lines D1 to Dn in the transverse direction orthogonal to the scanning lines S1 to Sm. The pixels E11 to Emn are expressed by an equivalent circuit (as referred to FIG. 7) composed of a diode and a condenser arranged in parallel. In order to prevent the illustration from being complicated, the pixels E11 to Emn to luminesce are shown with only diodes, and the pixels E11 to Emn not to luminesce are shown with only condensers in FIG. 8 and FIG. 9.

The cathode drive circuit 2 is provided with a plurality of scanning switches 21 to 2m corresponding to the individual scanning lines S1 to Sm. On the basis of the control signals of the control unit 4, the scanning switches 21 to 2m connect the individual scanning lines S1 to Sm selectively to the unselected potential Vb or the earth potential (0V).

The anode drive circuit 3 includes constant current sources 30 for feeding drive currents individually to the individual drive lines D1 to Dn, and drive switches 31 to 3n capable of connecting the individual drive currents from the constant current sources 30 to the individual drive lines D1 to Dn. The switching of each of the drive switches 31 to 3n is determined on the basis of the control signal from the control unit 4.

The control unit 4 outputs the control signals individually to the cathode drive circuit 2 and the anode drive circuit 3, and selectively turn ON/OFF the scanning switches 21 to 2m and the drive switches 31 to 3n corresponding to the scanning lines S1 to Sm and the drive lines D1 to Dn necessary for causing the pixels E11 to Emn to luminesce.

The reset circuit 5 is composed of a plurality of reset switches 50 individually connected with the drive lines D1 to Dn. These reset switches 50 connect the drive lines D1 to Dn to the earth potential, while next scanning lines S1 to Sm are being selected after arbitrary scanning lines S1 to Sm were selected by the scanning switches 21 to 2m, thereby to release the charges from the pixels E11 to Emn. The period, for which the electric charge stored in the pixels E11 to Emn is released by the reset circuit 5, is called the "reset period". For this reset period, not only the drive lines D1 to Dn but also the scanning lines S1 to Sm are connected to the earth potential.

The control circuit 4 turns ON the scanning switches 21 to 2m sequentially to select the scanning lines S1 to Sm sequentially, and turns ON/OFF the individual drive switches 31 to 3n to display characters and drawings on the organic EL panel 1.

DISCLOSURE OF THE INVENTION

Problems that the Invention is to Solve

However, there exists a problem that the pixels E11 to Emn have different luminous brightnesses in dependence upon the number of luminous pixels on the scanning lines S1 to Sm selected. When all the pixels E21 to E2n of the scanning line S2 are caused to luminesce, as shown in FIG. 8(*a*), the pixels E21 to E2n luminesce in high brightness. When only the pixel E21 is caused to luminesce, as shown in FIG. 9(*a*), on the other hand, the problem is that the brightness becomes lower than that of the case, in which all the pixels E21 to E2n are caused to luminesce.

The reason for this problem is described in the following. When all the pixels E21 to E2n of the scanning line S2 are caused to luminesce, all the individual drive lines D1 to Dn are connected with the constant current sources 30. Therefore, the electric current IS2 flown into the scanning line S2 from the pixels E11 to E1n and E31 to Emn of the scanning lines S1 and S3 to Sm unselected is so high that the luminous waveform takes a pulse shape, as shown in FIG. 8(*b*). When only the pixel E21 is caused to luminesce, however, the drive lines D2 to Dn are not connected to the constant current sources 30. Therefore, the pixels E12 to E1n, E32 to E2n, - - - , and Em2 to Emn on the scanning lines S1, S2 to Sm in the unselected states have large capacities as condensers so that the electric current IS2 to flow into the scanning line S2 is relatively small. As shown in FIG. 9(*b*), the rise of the luminous waveform becomes so blunt as to reduce the luminous brightness.

The present invention has been conceived in view of those problems, and contemplates to provide an organic EL display device, in which the luminous brightness of pixels is not made different by the number of pixels to luminesce on the scanning line selected, and a method for driving the display device.

MEANS FOR SOLVING THE PROBLEMS

According to the invention, there is provided an organic EL display device comprising: a dot-matrix type organic EL panel having a plurality of scanning lines and a plurality of drive lines; scanning switch means for connecting the scanning lines freely to a first potential or a second potential; drive switch means for connecting the drive lines freely to a drive current source or an off potential; and control means for causing the scanning switch means to connect the scanning lines to the first potential thereby to select the scanning lines sequentially and to control the connected state of the drive switch means. The control means changes, according to the number of the drive lines to be connected to the drive current source, the resistance of the scanning switch means corresponding to the scanning lines connected to the second potential to become an unselected state, into at least two stages.

According to the invention, the scanning switch means includes a first transistor for connecting the scanning lines to the first potential, and a second transistor for connecting the scanning lines to the second potential.

According to the invention, the control means changes, according to the number of the drive lines to be connected to the drive current source, the bias voltage of the second transistor corresponding to the scanning lines connected to the second potential to become the unselected state, thereby to change the resistance.

According to the invention, further comprised is temperature detecting means for detecting the temperature of the organic EL panel thereby to output temperature data.

According to the invention, the control means changes, according to the number of the drive lines to be connected to the drive current source and the temperature data, the resistance of the scanning switch means connected to the second potential.

According to the invention, there is provided an organic EL display device comprising: a dot-matrix type organic EL panel having a plurality of scanning lines and a plurality of drive lines; scanning switch means for connecting the scanning lines freely to a first potential or a second potential; drive switch means for connecting the drive lines freely to a drive current source or an off potential; and control means for causing the scanning switch means to connect the scanning lines to the first potential thereby to select the scanning lines sequentially and to control the connected state of the drive switch means. The scanning switch means includes a first transistor for connecting the scanning lines to the first potential, and a second transistor for connecting the scanning lines to the second potential, and the control means changes, according to the number of the drive lines to be connected to the drive current source, the bias voltage of the second transistor corresponding to the scanning lines connected to the second potential to become an unselected state.

According to the invention, there is provided a drive method for an organic EL display device, comprising: connecting a plurality of scanning lines individually to one of a first potential and a second potential; and connecting a plurality of drive lines individually to a drive current source or an off potential. According to the number of the drive lines to be connected to the drive current source, the resistance of the scanning switch means connected to the second potential is changed into at least two stages.

According to the invention, the scanning switch means includes a first transistor for connecting the scanning lines to the first potential, and a second transistor for connecting the scanning lines to the second potential, and the control means changes, according to the number of the drive lines to be connected to the drive current source, the bias voltage of the second transistor corresponding to the scanning lines connected to the second potential to become the unselected state, thereby to change the resistance.

According to the invention, according to the number of the drive lines to be connected to the drive current source and the temperature of the organic EL panel, the resistance of the scanning switch means connected to the second potential.

According to the invention, there is provided a drive method for an organic EL display device, comprising: connecting a plurality of scanning lines individually to one of a first potential and a second potential; and connecting a plurality of drive lines individually to a drive current source or an off potential. The scanning switch means includes a first transistor for connecting the scanning lines to the first potential, and a second transistor for connecting the scanning lines to the second potential, and the control means changes, according to the number of the drive lines to be connected to the drive current source, the bias voltage of the second transistor corresponding to the scanning lines connected to the second potential to become the unselected state.

EFFECTS OF THE INVENTION

In accordance with the number of pixels to luminesce on a scanning line selected, the resistance of scanning switch means corresponding to the scanning line unselected is properly changed so that the dispersion of the luminous brightness of the pixels can be reduced.

BRIEF DESCRIPTION OF THE DRAWINGS

FIG. 5 is an explanatory diagram of a memory unit of the same mode of embodiment.

BEST MODE FOR CARRYING OUT THE INVENTION

Figure 1:
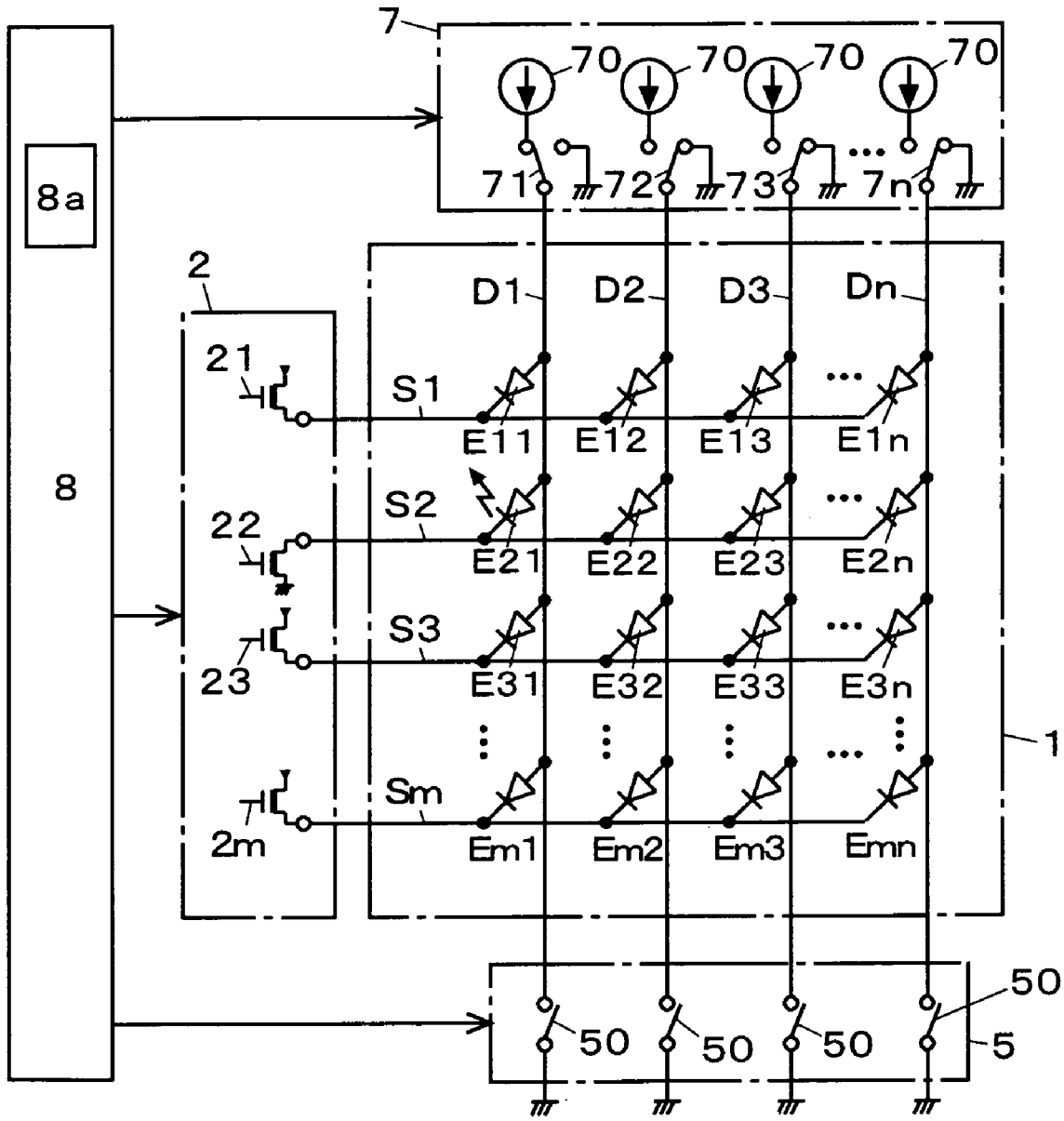
FIG. 1 is a configuration diagram of an organic EL display device showing a first mode of embodiment of the invention.
Figures 2, 3:
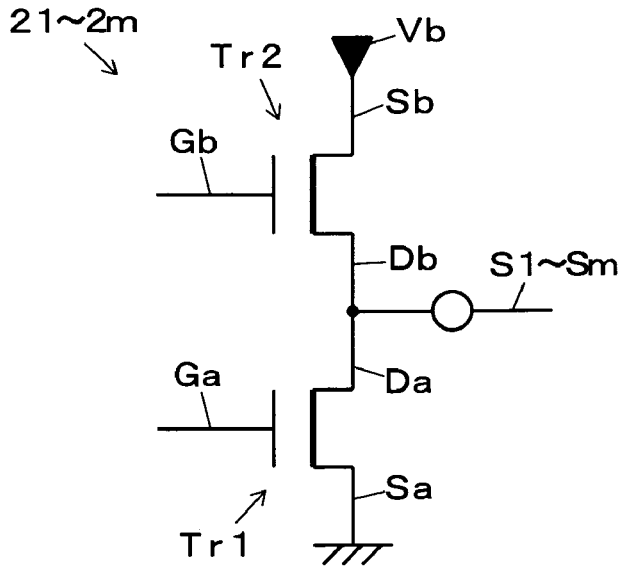
FIG. 2 is a circuit diagram of a scanning switch showing the same mode of embodiment.
FIG. 3 is an explanatory diagram of a memory unit of the same mode of embodiment.

One mode of embodiment of the invention is described in the following with reference to the accompanying drawings. FIG. 1 to FIG. 3 show a first mode of embodiment. The organic EL display device is configured to include an organic EL panel 1, a cathode drive circuit 2, an anode drive circuit 7, a control unit 8 (or control means), and a reset circuit 5.

In the organic EL panel 1, pixels E11 to Emn are arranged in a matrix state. These pixels E11 to Emn are disposed at intersections between a plurality of scanning lines S1 to Sm in the longitudinal direction and a plurality of drive lines D1 to Dn in the transverse direction orthogonal to the scanning lines S1 to Sm.

The cathode drive circuit 2 is provided with a plurality of scanning switches 21 to 2m (or scanning switch means) corresponding to the individual scanning lines S1 to Sm. Each of the scanning switches 21 to 2m is configured (as referred to FIG. 2) to include a first transistor Tr1 for connecting the scanning lines S1 to Sm with the earth potential (or the first potential), and a second transistor Tr2 for connecting the scanning lines S1 to Sm with an unselected potential Vb (or the second potential). The first transistor Tr1 is the N-channel type transistor, and the second transistor Tr2 is the P-channel type transistor. In order to prevent the illustration of FIG. 1 from become complicated, the individual scanning switches 21 to 2m are shown to have one of the first transistor Tr1 and the second transistor Tr2.

The first transistor Tr1 and the second transistor Tr2 are composed of gates Ga and Gb, sources Sa and Sb and drains Da and Db, respectively. The first transistor Tr1 has its source Sa connected with the earth potential and its drain Da connected with the scanning lines S1 to Sm. The first transistor Tr1 connects, based on the drive signal inputted from the gate Ga, the scanning lines S1 to Sm selected, to the earth potential. The second transistor Tr2 has its source Sb connected with the unselected potential Vb and its drain Db connected with the scanning lines S1 to Sm. The second transistor Tr2 connects, based on the drive signal inputted from the gate Gb, the scanning lines S1 to Sm unselected, with the unselected potential Vb. The scanning lines S1 to Sm are sequentially brought into the selected state by the scanning switches 21 to 2*m*.

The reset circuit 5 is composed of a plurality of reset switches 50 individually connected with the drive lines D1 to Dn. These reset switches 50 connect the drive lines D1 to Dn to the earth potential, while next scanning lines S1 to Sm are being selected after arbitrary scanning lines S1 to Sm were selected by the scanning switches 21 to 2m, thereby to release the charges from the pixels E11 to Emn.

The anode drive circuit 7 includes constant current sources 70 (or drive current sources) for feeding drive currents individually to the individual drive lines D1 to Dn, and drive switches 71 to 7n capable of connecting, based on the control signals from the control unit 8, the individual drive lines D1 to Dn selectively to the constant current sources 70 or the earth potential (or an OFF potential).

The control unit 8 is constituted of a display controller for performing, when it receives running information of the vehicle from various sensors, a predetermined processing to display the various kinds of information such as the vehicle speed, the engine speed or the fuel residue in the organic EL panel 1. The control unit 8 outputs control signals individually to the cathode drive circuit 2 and the anode drive circuit 7, so that the scanning switches 21 to 2m and the drive switches 71 to 7n corresponding to the scanning lines S1 to Sm and the drive lines D1 to Dn necessary for causing the pixels E11 to Emn to luminesce are selectively turned ON/OFF to display the predetermined information on the organic EL panel 1.

The control unit 8 is provided with a memory unit 8*a* such as an EEPROM having voltage data VGS1 to VGSn stored therein. The voltage data VGS1 to VGSn is at the voltage level as the drive signal to be applied to the gate Gb of the transistor Tr2. Here, the voltage level indicates the voltage (or the bias voltage) between the source Sb and the gate Gb of the transistor Tr2. The voltage data VGS1 to VGSn corresponds (as referred to FIG. 3) to the numbers 1 to n of the drive switches 71 to 7n to be turned ON.

Next, here is described the feature of the invention, i.e., the drive signal which is to be outputted to the scanning switches 21 to 2m corresponding to the scanning lines S1 to Sm unselected. The control unit 8 reads the voltage data VGS1 to VGSn from the memory unit 8*a* in accordance with the numbers 1 to n of the pixels to luminesce on the scanning lines S1 to Sm selected, and outputs the drive signals based on the voltage data VGS1 to VGSn read, to the transistor Tr2 of the scanning switches 21 to 2m corresponding to the scanning lines S1 to Sm unselected. When the number of pixels to luminesce on the scanning line S2 is n, the drive signals based on the voltage data VGSn are outputted to the transistor Tr2 of the scanning switches 21 and 23 to 2m corresponding to the scanning lines S1 and S3 to Sm unselected. When the number of pixels to luminesce on the scanning line S2 is one, the drive signal based on the voltage data VGS1 is outputted to the transistor Tr2 of the scanning switches 21 and 23 to 2m corresponding to the scanning lines S1 and S3 to Sm unselected.

If the voltage between the drain Db and the source Sb of the transistor Tr2 is designated by [Vds], and if the current to flow from the drain Db to the source Sb is designated by [Id], the change of the voltage level to be applied to the gate Gb of the transistor Tr2 is made substantially identical to a change of the resistance R of the transistor Tr2, by relation of Formula (1):

$$R = Vds/Id \qquad \text{Formula (1).}$$

Figure 4:
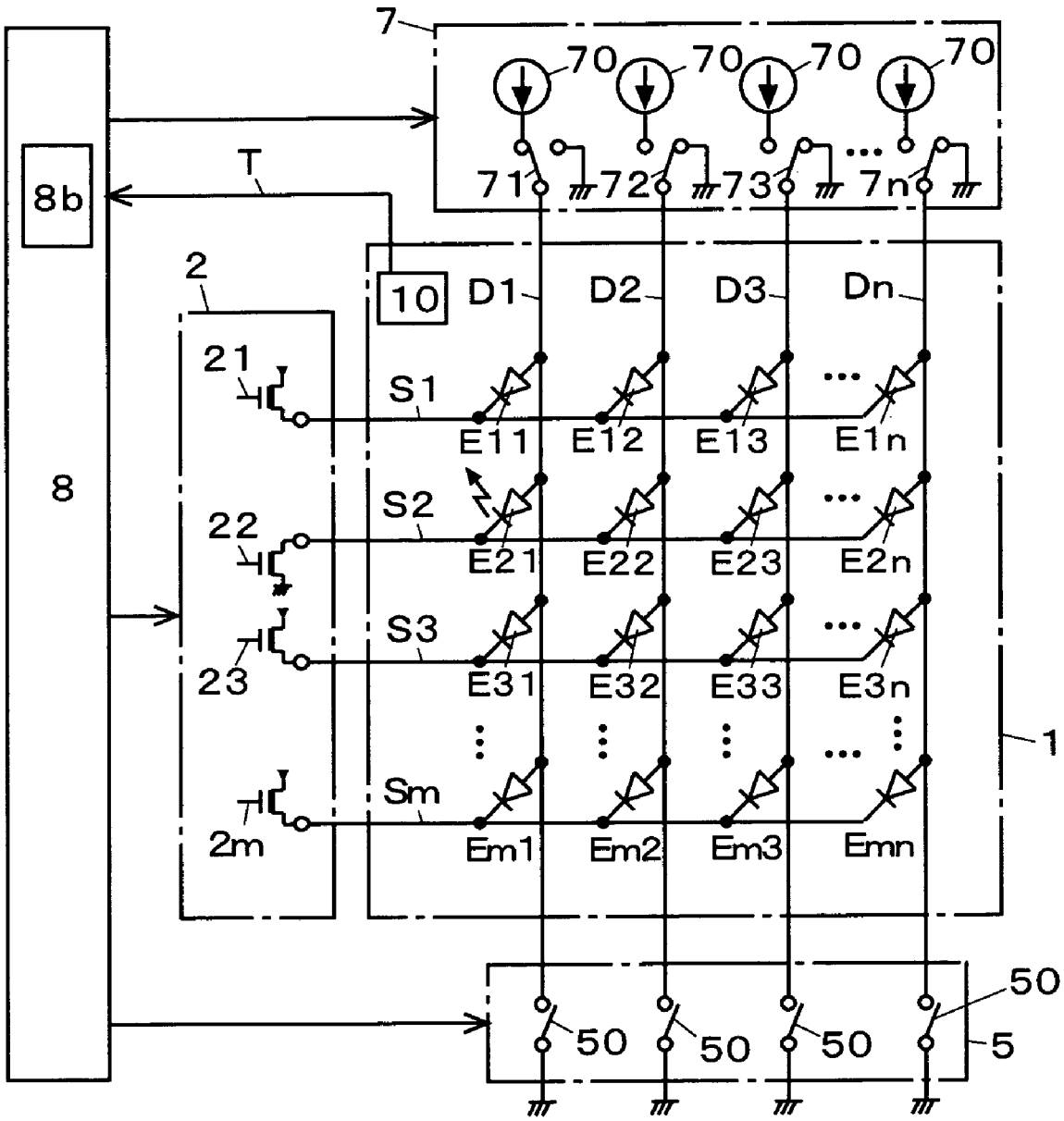
FIG. 4 is a configuration diagram of an organic EL display device showing a second mode of embodiment of the invention.
Figure 6:
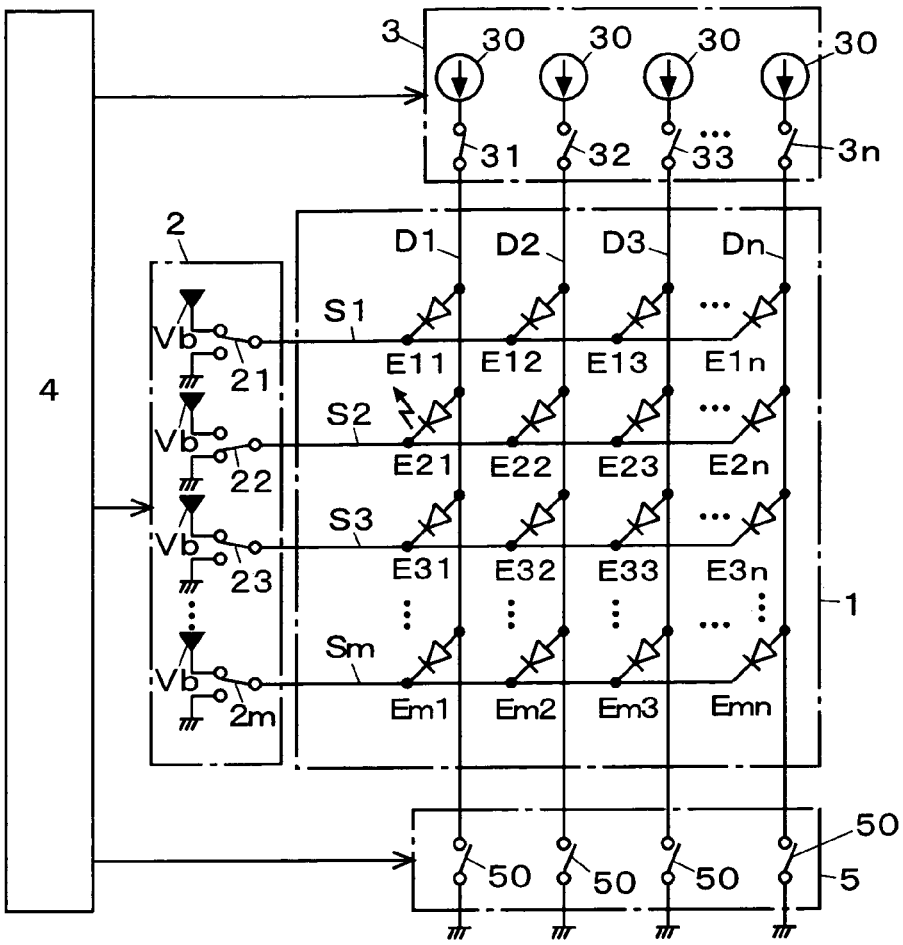
FIG. 6 is a configuration diagram of an organic EL display device showing an example of the prior art.
Figure 7:
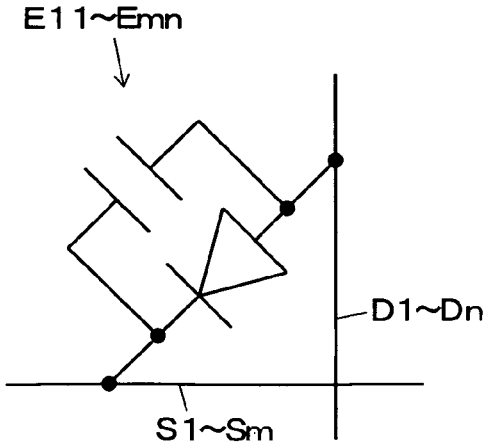
FIG. 7 is an explanatory diagram of an equivalent circuit of a pixel and shows the same example of the prior art.
Figure 8:
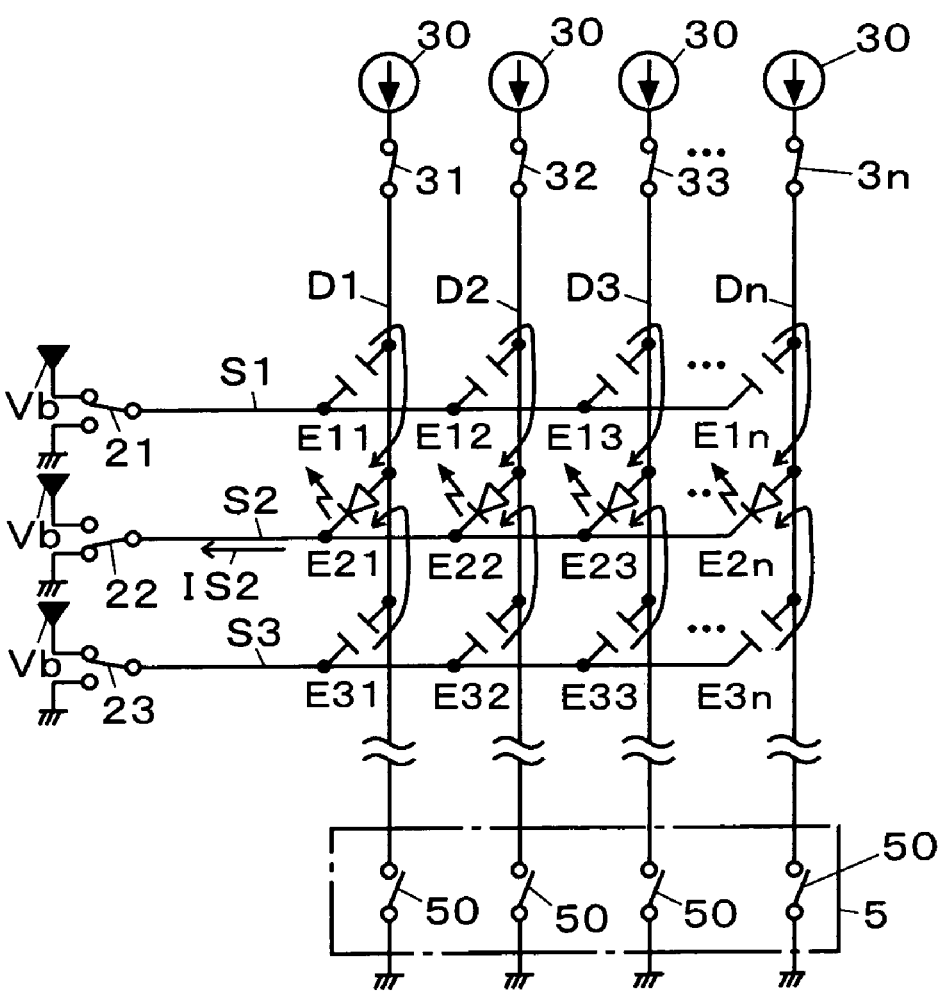
FIG. 8 is a partial diagram of the organic EL panel and shows the same example of the prior art.
Figure 8:
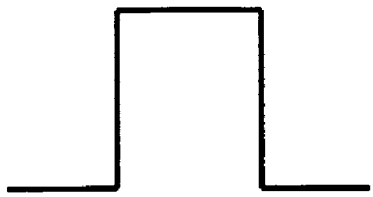
Figure 9:
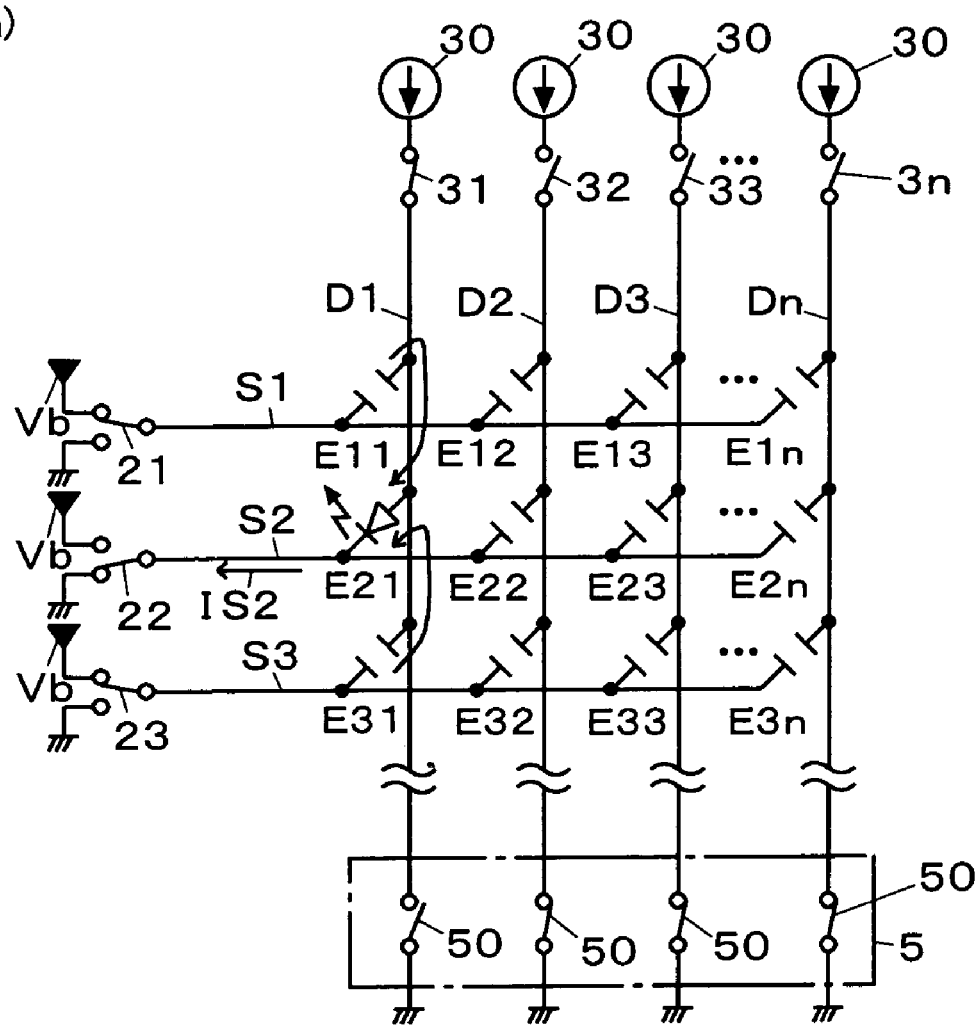
FIG. 9 is a partial diagram of the organic EL panel and shows the same example of the prior art.
Figure 9:
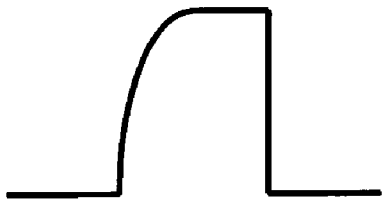

FIG. 4 and FIG. 5 show a second mode of embodiment. This second mode of embodiment is different from the first mode of embodiment only in a temperature sensor 10 and a memory unit 8*b*. However, the remaining components are identical to those of the first mode of embodiment, and the detailed description is omitted by designating the components by the common reference numerals.

The temperature sensor 10 (or temperature detecting means) detects the temperature of the organic EL panel 1, and outputs a temperature signal T or analog data to the control unit 8. The temperature sensor 10 is made of a temperature detecting element such as a thermistor, and may be either adhered to the organic EL panel 1 or arranged at a predetermined spacing from the organic EL panel 1 thereby to detect the temperature of the organic EL panel 1 indirectly. The control unit 8 is provided with the not-shown A/D converter (or the temperature detecting means), by which the aforementioned temperature signal T is converted into digital data such as temperature data t01 to t64.

The control unit 8 is provided with the memory unit 8*b*, in which the voltage data VGS101 to VGSn64 at the voltage level to be applied to the gate Gb of the transistor Tr2 is stored. The voltage data VGS110 to VGSn64 correspond (as referred to FIG. 5) to the numbers 1 to n of the drive switches 71 to 7n to be turned ON and the temperature data t01 to t64.

The control unit 8 reads the voltage data VGS101 to VGSn64 from the memory unit 8*b* in accordance with the numbers 1 to n of the pixels to luminesce on the scanning lines S1 to Sm selected and the temperature data t01 to t64, and outputs the drive signals based on the voltage data VGS1 to VGSn read, to the transistor Tr2 of the scanning switches 21 to 2m. In case the temperature data obtained on the basis of the temperature signal T outputted from the temperature sensor 10 is "t03" and when the number of pixels to luminesce on the scanning line S2 is n, the drive signals based on the voltage data VGSn03 are outputted. When the number of pixels to luminesce on the scanning line S2 is one, the drive signal based on the voltage data VGS103 is outputted.

According to the first and second modes of embodiment, in response to the numbers 1 to n of the pixels to luminesce at the scanning lines S1 to Sm selected, that is, the numbers 1 to n of the drive switches 71 to 7n to become ON, the voltage data VGS1 to VGSn and VGS101 to VGSn64 are read out from the memory unit 8*a* or 8*b*, and the drive signals based on the read voltage data VGS1 to VGSn and VGS101 to VGSn64 can be outputted to the transistor Tr2 of the scanning switches 21 to 2m. As a result, it is possible to reduce the dispersion in the luminous brightness by the numbers 1 to n of the pixels to luminesce on the selected scanning lines S1 to Sm.

Here in the first mode of embodiment, the voltage level to be applied to the transistor Tr2 is changed at n-stages in accordance with the numbers 1 to n of the pixels to luminesce on the scanning lines S1 to Sm selected. However, similar effects can be expected by changing the voltage level in at least two stages.

Since the capacities of the pixels E11 to Emn as the capacitors change with the temperature, in response to the numbers 1 to n of the pixels to luminesce on the scanning lines S1 to Sm selected and the temperature data t01 to t64, it is desired to output the drive signals based on the voltage data VGS1 to VGSn read, to the transistor Tr2 of the scanning switches 21 to 2m corresponding to the scanning lines S1 to Sm unselected, as in the second mode of embodiment.

INDUSTRIAL APPLICABILITY

The present invention is suited for an organic EL display device having a dot-matrix type organic EL panel, which includes a plurality of anode lines and a plurality of cathode lines.

The invention claimed is:

1. An organic EL display device comprising:

a dot-matrix type organic EL panel having a plurality of scanning lines and a plurality of drive lines;

a plurality of scanning arrangements corresponding to number of the plurality of scanning lines, each of the plurality of scanning arrangements connecting said scanning lines freely to a first potential or a second potential;

a drive switch arrangement for connecting said drive lines freely to a drive current source or an off potential; and a control arrangement for causing said scanning switch arrangement to connect said scanning lines to said first potential thereby to select said scanning lines sequentially and to control the connected state of said drive switch arrangement, wherein each of said scanning switch arrangements includes a first transistor for connecting said scanning lines to said first potential, and a second transistor for connecting said scanning lines to said second potential, and said control arrangement controls said first transistors of scanning switch arrangements, which are not selected for luminesce, to be connected to said first potential, wherein the first potential changes depending upon numbers of pixels to luminesce on scanning lines that are selected for luminesce.

2. An organic EL display device as set forth in claim 1, wherein said control arrangement changes, according to the number of said drive lines to be connected to said drive current source, the bias voltage of said second transistor corresponding to said scanning lines connected to said second potential to become the unselected state, thereby to change said resistance.

3. An organic EL display device as set forth in claim 1, further comprising a temperature detecting arrangement for detecting the temperature of said organic EL panel thereby to output temperature data, and said control arrangement changes, according to the number of said drive lines to be connected to said drive current source and said temperature data, said resistance of said scanning switch arrangement connected to said second potential.

4. An organic EL display device as set forth in claim 1, wherein said control arrangement changes, according to the number of said drive lines to be connected to said drive current source, the resistance of said second transistor corresponding to said scanning lines connected to said second potential to become an unselected state.

* * * * *

UNITED STATES PATENT AND TRADEMARK OFFICE

CERTIFICATE OF CORRECTION

PATENT NO. : 7,649,512 B2
APPLICATION NO. : 10/590772
DATED : January 19, 2010
INVENTOR(S) : Junichi Maruyama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 424 days.

Signed and Sealed this

Twenty-third Day of November, 2010

David J. Kappos

David J. Kappos
*Director of the United States Patent and Trademark Office*